United States Patent [19]

Wilson

[11] 4,194,735

[45] Mar. 25, 1980

[54] BATTING STANCE AND STRIDE PRACTICE APPARATUS

[76] Inventor: Richard A. Wilson, 517 W. Maple, Centerville, Iowa 52544

[21] Appl. No.: 884,683

[22] Filed: Mar. 8, 1978

[51] Int. Cl.[2] ..... A63B 69/00

[52] U.S. Cl. ..... 273/26 R

[58] Field of Search ..... 273/181, 197 R, 197 A, 273/26 R, 25, 183 B, 183 A, 285, 187 A, 187 B, 187 R, 195 R, 195 A, 195 B, 196; 35/29 R, 29 A, 37, 29 E, 29 C; 272/97

[56] References Cited

U.S. PATENT DOCUMENTS

| | | | |
|---|---|---|---|
| 1,815,443 | 7/1931 | Mitchell | 35/29 C |
| 2,827,837 | 6/1958 | Castle | 35/29 C |
| 3,139,281 | 6/1964 | Nicholson | 273/285 |
| 3,300,219 | 1/1967 | Sipos | 273/187 R |
| 3,342,487 | 9/1967 | David | 273/26 R |
| 3,784,208 | 1/1974 | Weygandt | 273/183 A |
| 3,815,906 | 6/1974 | Hermo | 273/187 R |
| 3,868,116 | 2/1975 | Ford | 273/187 R |
| 3,979,116 | 9/1976 | Matchick | 35/29 R |
| 4,000,905 | 1/1977 | Shirhall | 273/187 A |

FOREIGN PATENT DOCUMENTS

| | | | |
|---|---|---|---|
| 430762 | 2/1935 | United Kingdom | 273/183 A |

*Primary Examiner*—Richard C. Pinkham
*Assistant Examiner*—T. Brown
*Attorney, Agent, or Firm*—Zarley, McKee, Thomte, Voorhees & Sease

[57] ABSTRACT

A batting practice trainer for foot placement is disclosed comprising two oppositely disposed flat support members having a home plate member disposed therebetween and attached thereto, and placement guide members comprised of pliable, yieldable material and having a pivot foot recess, a first stride foot recess parallel to the pivot foot recess, and a second stride foot recess therein, and mounted in opposing disposition on the top surface of each support member. The first stride foot recess is connected to the second stride foot recess to allow unencumbered passage of the stride foot of a batter during the swinging motion. The depth of the recesses in the foot placement guide members is sufficient to provide tactile guidance for the batter's feet during the swinging motion, yet yielding to improper foot placement. The recesses are traffic light color coded to provide visual guidance of the proper batting stance with the pivot foot recess being red, the first stride foot recess being yellow, and the second stride foot recess being green. The center of the home plate member has a hinge and is foldable to provide compaction for transportation.

15 Claims, 8 Drawing Figures

BATTING STANCE AND STRIDE PRACTICE APPARATUS

BACKGROUND OF THE INVENTION

This invention relates to a batting practice trainer and particularly to a foot placement training device for a baseball stance. Prior devices provided rigid foot guides or visual foot guides only. Visual foot guides do not provide the tactile guidance necessary for efficient and effective batting training since the batter's vision should be concentrated on the ball rather than foot placement. Rigid foot guides, on the other hand, are dangerous in that deviation from the proper foot placement will result in the batter losing his balance and possibly falling in addition to interferring with his concentration.

SUMMARY OF THE INVENTION

A foot placement training device for a baseball batting stance is disclosed, comprising two oppositely disposed substantially flat support members attached therebetween by a home plate element, a pair of pliable, yieldable foot placement guide members mounted to the top surface of each support member and oppositely disposed with each foot placement guide having a color coded pivot foot recess, first stride foot recess, and a second stride foot recess. The recesses are of sufficient depth in the yieldable, pliable material of the foot placement guide to provide tactile guidance to the batter's foot during the swinging motion with the first stride foot recess being connected to the second stride foot recess to allow unobstructed passage of the stride foot of the batter during the swinging motion. The pivot foot recess and the first stride recess are generally perpendicular to the home plate element and the second stride foot recess is generally obliquely disposed with respect to the first stride foot recess. The recesses are color coded in a traffic light manner with the pivot foot recess being red, the first stride foot recess being yellow, and the second stride foot recess being green. The home plate element is foldable along its center line via hinge means to allow compaction for transportation and includes handle apertures for carrying.

It is a principal object of this invention to provide an improved batting practice trainer.

A further object of this invention is to provide a batting practice trainer that provides yieldable, tactile foot guidance during the swinging motion.

A still further object of the invention is to provide a batting practice trainer that provides simple color coded foot placement sequence for a proper batting swing.

A still further object of the invention is to provide a batting practice trainer that is easily compacted for transporting.

A still further object of the invention is to provide a batting practice trainer that reduces the possibility of injury during training, yet allows total concentration on the ball.

A still further object of the invention is to provide a batting practice trainer that provides a simple color coded sequence of foot placement for teaching young children.

A still further object of the invention is to provide a batting practice trainer that is durable in use, economical to manufacture, and refined in appearance.

DESCRIPTION OF THE PREFERRED EMBODIMENT

Figure 1:
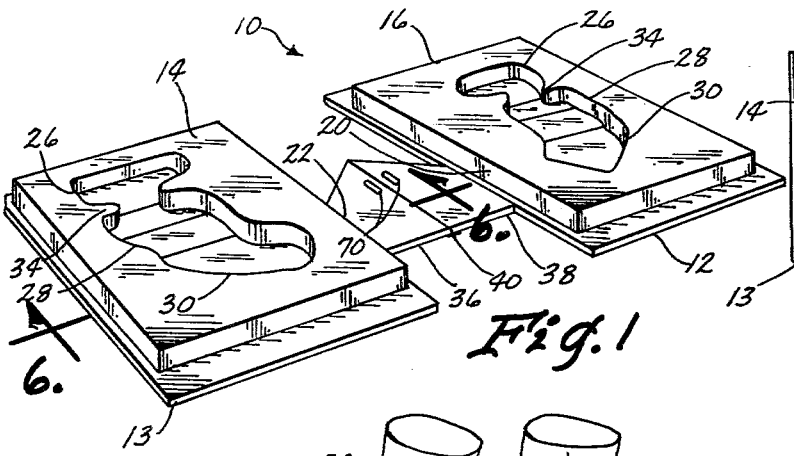
FIG. 1 is a perspective view of the invention.

The numeral 10 generally refers to the foot placement training device of this invention shown in FIG. 1.

Figure 2:
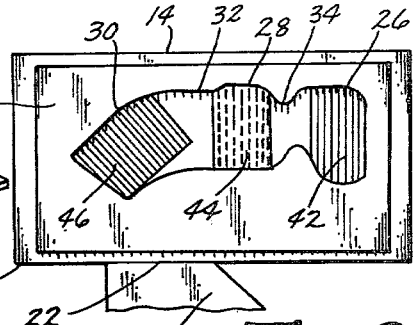
FIG. 2 is a partial top view of the invention.
Figure 4:
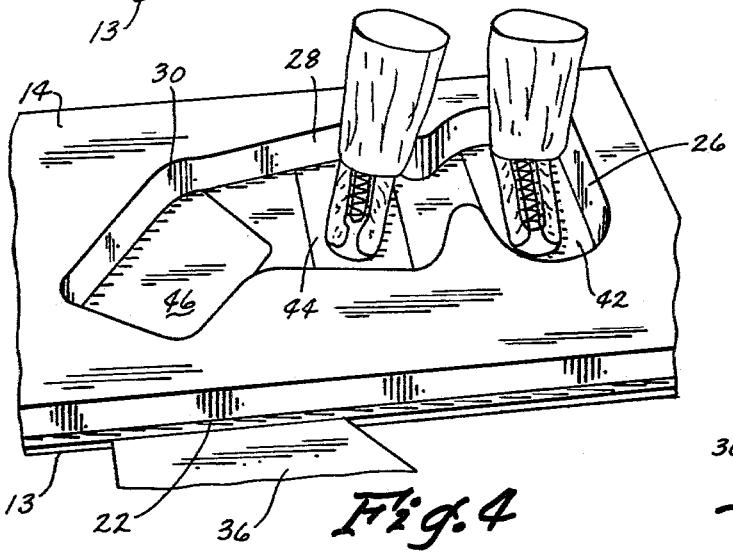
FIG. 4 is an enlarged partial view similar to FIG. 3.
Figure 3:
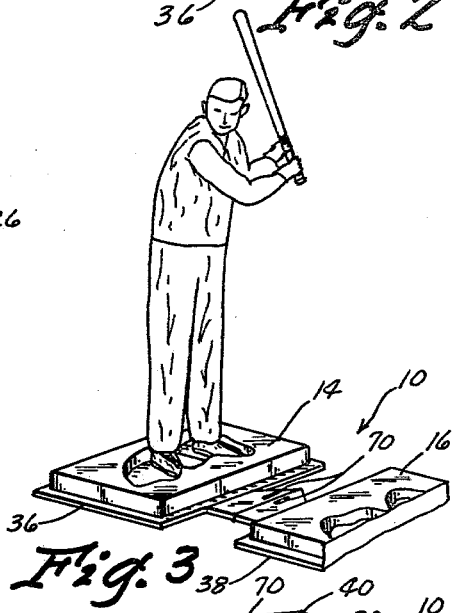
FIG. 3 is a perspective view of the invention and a batter in the ready position.
Figure 5:
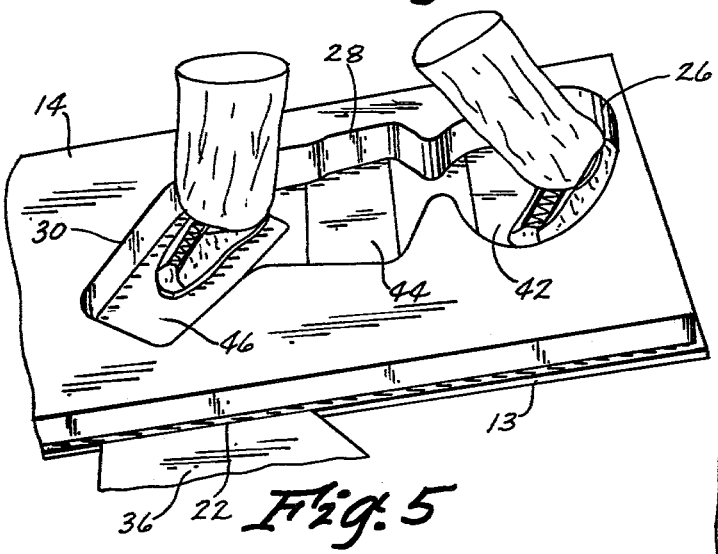
FIG. 5 is an enlarged partial view similar to FIG. 4, illustrating completion of the swinging motion.

Training device 10 comprises flat support members 12 and 13, foot placement guides 14 and 16, and home plate element 18. Opposite edges 20 and 22 of home plate element 18 are securely attached to support members 12 and 13, respectively, as shown in FIG. 1. Foot placement guide 14 is securely mounted to the top surface 24 of left support member 13 and comprises pivot foot recess 26, first stride foot recess 28, and second stride foot recess 30. A left handed batter in the ready position would place his left foot in pivot recess 26 and his right foot in recess 28 (FIGS. 3 and 4). Cavity 32 connects recess 28 and recess 30 (FIG. 2) so that the right foot may stride unencumbered from recess 28 to recess 30 during the swinging motion (FIG. 5). Cavity 34 connects recess 26 and recess 28 to aid in initial placement of the feet.

Figure 7:
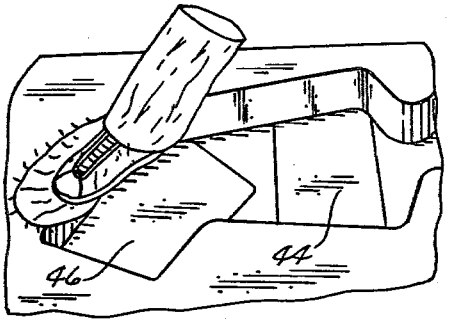
FIG. 7 is an enlarged partial view similar to FIG. 5.

Recess 26 is generally parallel to recess 30 and perpendicular to home plate element 18 to provide the proper foot placement for the batter's ready position. Recess 30 is generally obliquely disposed with respect to recess 28 to provide the proper foot placement for the termination of the batting swing (FIG. 5). The depth of the respective recesses provides tactile guidance for initial foot placement and foot movement during the swinging motion. Foot placement guide 14 is comprised of a yieldable, pliable material, preferably foam rubber, with a preferred recess depth of three inches. The yieldable quality of placement guide 14 prevents the batter from losing his balance and stumbling should foot placement be improper during the swinging motion as illustrated in FIG. 7. The batter can maintain his full concentration and keep his eye on the ball because he can feel any deviation in proper foot placement during the swinging motion.

Foot placement guide (16) is color coded utilizing the "traffic light" color code with recess 26 colored red as designated by the vertical lines 42 (FIG. 2), recess 28 colored yellow as designated by the cross hatching 44, and recess 30 colored green as designated by the diagonal lines 46. This color code provides an easily understandable sequence guide of foot movement for teaching young children.

Foot placement guide 16 is the right hand batter's equivalent to foot placement guide 14 hereinbefore described. Guide 16 comprises recesses corresponding to those of guide 14 and is securely attached to a top surface of support member 12.

Figure 8:
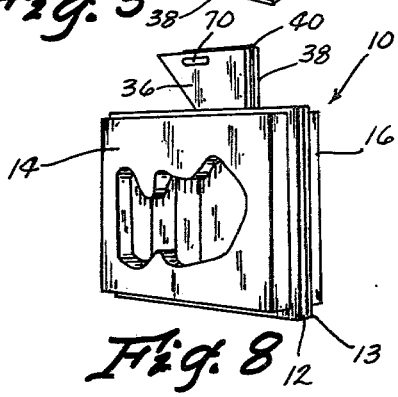
FIG. 8 is a perspective view of the device in a carrying position.
Figure 6:
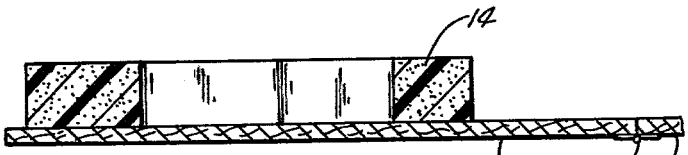
FIG. 6 is an enlarged sectional view seen on line 6—6 of FIG. 1.

Home plate element 18 is comprised of portion 36 and portion 38 pivotally connected by hinge 40 (FIG. 6) to allow device 10 to fold into the configuration shown in FIG. 8. This allows easy transportation of the device which can be hand held by holding apertures 40.

In operation, training device 10 is utilized in either an outdoor or indoor environment in the unfolded position of FIG. 1. The batter places his pivot foot in recess 26 and his stride foot in recess 28 assuming the ready position shown in FIG. 3. The shape and parallel disposition of recesses 26 and 28 assures proper foot placement for the ready position. The batter then practices his swing with or without an actual ball being pitched over home plate element 18. The foot movement during the swinging motion consists of the stride foot passing through cavity 32 into recess 30 while the pivot foot pivots in recess 26, as shown in FIG. 5. Recess 26, cavity 32 and recess 30 provide tactile guidance for proper foot placement during the swinging motion because the batter can feel any improper deviation from proper foot placement. This touching perception of the foot placement guide, however, will not cause injury due to stumbling or falling nor affect concentration to any significant degree because of the yieldable nature of the material of which the guide is composed. Therefore, should the batter deviate from the proper position as illustrated in FIG. 7, he will feel the deviation and the material will yield to his foot. The batter is thus able to keep his eye on the ball, yet is still aware of improper foot placement. His concentration should not be affected by the foot guide since the possibility of stumbling due to deviation therefrom is eliminated by the yieldable nature of the guide material.

The color coding also provides a visual guide to proper foot placement in addition to simplifying the movement sequence for children. By using the "traffic light" color code, the proper sequence is easily understood by children.

The training device 10 is easily transported from place to place by folding the device about hinge 40 into the configuration shown in FIG. 8, and carrying it by means of hand apertures 40. The durable and light weight construction of the materials facilitates easy movement and longevity of use.

Thus, it can be seen that this device accomplishes at least all of its stated objectives.

What is claimed is:

1. A foot placement training device for a baseball batting stance, comprising, a substantially flat first support member having inner and outer edges, said inner edge adapted for placement adjacent home plate, and a first pliable, yieldable foot placement guide means mounted to the top surface of said support member, said guide means being an elongated continuous recess and having a pivot foot position, a first stride foot position generally parallel to said pivot foot position and perpendicular to said inner edge, and a second stride foot position, said pivot foot position, said first stride foot position, said second stride foot position having unobstructed passage therebetween, said recess being of a predetermined depth to provide tactile guidance for the batter's foot placement with said foot placement guide means being yieldable to foot placement in misalignment with said pivot foot position said first stride foot position and said second stride foot.

2. The device of claim 1 wherein said second stride foot position is generally obliquely disposed with respect to said first stride foot position.

3. The device of claim 1 wherein said foot placement guide means is comprised of foam rubber.

4. The device of claim 1 wherein said predetermined depth is approximately three inches.

5. The device of claim 1 wherein a home plate means having first and second opposing edges is attached to said first support member with said first edge of said home plate means abutting said inner edge of said first support member and a second support member having inner and outer edges is attached to said home plate means with said inner edge of said second support member abutting said second edge of said home plate means.

6. The device of claim 5 wherein a second pliable, yieldable foot placement guide means is mounted to the top surface of said second support member directly opposite said first foot placement guide means.

7. The device of claim 6 wherein said home plate means comprises hinge means at the center thereof to allow pivotal movement of said second support member toward said first support member so that the bottom surface of said first support member adjoins the bottom surface of said second support member.

8. The device of claim 1 wherein said first foot placement guide means comprises color coded visual guidance means for the batter's foot placement.

9. The device of claim 8 wherein said visual guidance means comprises said pivot foot position being a first color, said first stride foot position being a second color, and said second stride foot position being a third color.

10. The device of claim 9 wherein said first color is red, said second color is yellow, and said third color is green.

11. A foot placement training device for a baseball batting stance, comprising, a placement guide means having inner and outer edges, said inner edge adapted for placement adjacent home plate and having a pivot foot position, a first stride foot position generally parallel to said pivot foot position and perpendicular to said inner edge, and a second stride foot position, said first stride foot position being connected to said second stride foot position to allow unobstructed passage of the stride foot of a batter from said first stride foot position to said second stride foot position during a swinging motion.

said pivot foot position, said first stride foot position, and said second stride foot position being located in an elongated continuous recess in said guide means, said recess having a predetermined depth to provide tactile guidance for the batter's foot placement with said foot placement guide means being yieldable to foot placement in misalignment with said pivot foot position, said first stride foot position and said second stride foot position.

12. The device of claim 11 wherein said second stride foot position is generally obliquely disposed with respect to said first stride foot position.

13. The device of claim 11 wherein said predetermined depth is approximately three inches.

14. The device of claim 11 wherein said first foot placement guide means comprises color coded visual guidance means for the batter's foot placement.

15. The device of claim 14 wherein said visual guidance means comprises said pivot foot position being a first color, said first stride foot position being a second color, and said second stride foot position being a third color.

* * * * *